US005189272A

United States Patent [19]

McDonald et al.

[11] Patent Number: 5,189,272

[45] Date of Patent: Feb. 23, 1993

[54] BAG UTILIZING A MICROWAVE SUSCEPTOR AND NON-HEATED FLAPS

[75] Inventors: Duane L. McDonald, Maple Grove; Barbara E. Morrissette, Plymouth, both of Minn.

[73] Assignee: General Mills, Inc., Minneapolis, Minn.

[21] Appl. No.: 834,187

[22] Filed: Feb. 6, 1992

[51] Int. Cl.[5] ..... H05B 6/80; B65D 30/18

[52] U.S. Cl. ..... 219/10.55 E; 219/10.55 F; 99/DIG. 14; 426/107; 426/113; 426/234; 426/243

[58] Field of Search ..... 219/10.55 E, 10.55 M, 219/10.55 F; 426/107, 110, 111, 113, 123, 234, 243; 99/DIG. 14; 206/111, 234, 632; 383/98, 100, 120

[56] References Cited

U.S. PATENT DOCUMENTS

| | | | |
|---|---|---|---|
| 43,567 | 7/1864 | Campbell | 383/10 |
| 670,360 | 3/1901 | Lawler | 383/7 |
| 3,023,947 | 3/1962 | McDuffie | 426/111 |
| 3,570,751 | 3/1971 | Trewella | 426/110 |
| 3,851,574 | 12/1974 | Katz et al. | 426/107 |
| 3,865,301 | 2/1975 | Pothier et al. | 99/DIG. 14 |
| 3,973,045 | 8/1976 | Brandberg et al. | 426/110 |
| 4,038,425 | 7/1977 | Brandberg et al. | 426/107 |
| 4,292,332 | 9/1981 | McHain | 426/111 |
| 4,337,862 | 7/1982 | Suter | 206/632 |
| 4,450,180 | 5/1984 | Watkins | 426/107 |
| 4,641,005 | 2/1987 | Seiferth | 219/10.55 E |
| 4,691,374 | 9/1987 | Watkins et al. | 383/104 |
| 4,806,371 | 2/1989 | Mendenhall | 426/113 |
| 4,810,844 | 3/1989 | Anderson | 219/10.55 E |
| 4,864,090 | 9/1989 | Maxwell et al. | 219/10.55 E |
| 4,873,101 | 10/1989 | Larson et al. | 219/10.55 E |
| 4,890,439 | 1/1990 | Smart et al. | 53/410 |
| 4,892,744 | 1/1990 | Ylvisaker | 426/107 |
| 4,973,810 | 11/1990 | Brauner | 219/10.55 E |
| 5,011,299 | 4/1991 | Black, Jr. et al. | 219/10.55 E |
| 5,044,777 | 9/1991 | Watkins et al. | 219/10.55 E |

*Primary Examiner*—Bruce A. Reynolds
*Assistant Examiner*—Tuan Vinh To
*Attorney, Agent, or Firm*—L. MeRoy Lillehaugen; John A. O'Toole; Alan D. Kamrath

[57] ABSTRACT

A package for use in microwave ovens is disclosed in its preferred form of a flexible, tubular bag (18) including expandable side walls (26) interconnected between bottom and top walls (20, 22). The side walls (26) include pleats (**26*a*, 26*b*, 26*c*, 26*d*) which are folded in a collapsed condition of the bag (18) and expand due to internal expansion forces generated by the popping of kernels and the creation of water vapor. The openable end (28) opposite the permanent end wall (24) of the bag (18) is formed by V-shaped adhesive strips (34, 36) located between the bottom and top walls (20, 22) and the pleats (26*a*, 26*b*, 26*c*, 26*d*). Large, triangular shaped, unsealed areas (38*a*, 38*b*, 38*c*, 38*d*) formed and defined by the bottom, top and side walls (20, 22, 26) between the free ends thereof and the adhesive strips (34, 36) function as flaps separated from the interior of the bag (18) by the adhesive strips (34, 36) and maintained at a cooler surface temperature than the remainder of the bag (18) for grasping by the consumer to remove the bag (18) from the microwave oven and to peel the adhesive strips (34, 36) apart to open the bag (18**) after popping.

20 Claims, 3 Drawing Sheets

BAG UTILIZING A MICROWAVE SUSCEPTOR AND NON-HEATED FLAPS

BACKGROUND OF THE INVENTION

1. Field of the Invention

This invention relates generally to packages for use in microwave ovens, and pertains more particularly to a flexible bag having non-heated flaps spaced from the susceptor that converts microwave energy to thermal energy.

2. Description of the Prior Art

Packages especially suited for popping corn in microwave ovens have met with tremendous success. Essential to obtaining effective popping of the corn kernels is a susceptor pad such as that described in Brastad U.S. Pat. No. 4,267,420 and Brastad et al U.S. Pat. No. 4,230,924. There are a number of more recent patents in which the popping of corn is accomplished with the aid of a susceptor pad. Basically, the susceptor pad material described in said numerically-identified patents (and also the more recently issued ones which need not be specifically identified) involves a metallized film that converts some of the microwave energy into thermal energy. Inasmuch as elevated temperatures are necessary to effectively pop corn, the entire package becomes extremely hot and difficult to handle by the time the popping cycle has been completed and the package is ready to be removed from the microwave oven. The problem is compounded when the material and/or number of layers of material forming the package is minimized, thereby reducing the insulating quality of the package itself and increasing heat transfer therethrough. Because of the elevated temperatures, children are discouraged from removing the package from the microwave oven without adult supervision. A partial and somewhat impractical solution to the problem has been that the individual consumer resorts to a hot pad or towel to remove the package and during the subsequent handling thereof. However, this is bothersome and frequently the consumer will neglect to use such an item with the consequence that discomfort, and in some cases burning, is experienced when the heated package is directly touched with one's fingers. U.S. Pat. No. 4,864,090 shows a further solution to the problem by providing a non-heated flap extending from the bottom of the bag. However, it can be recognized that the non-heated flap requires extra manufacturing steps and requires extra bag material which increases the cost of the package material over packages not including such non-heated flaps.

SUMMARY OF THE INVENTION

Accordingly, an important object of the present invention is to provide a means enabling the consumer to handle readily a hot package, such as that in which popcorn has been popped, without having to resort to any supplemental aid or auxiliary means. More specifically, an aim of the invention is to provide non-heated flaps located in a spaced relation with the package's susceptor pad. In that the flaps remain comparatively cool, considerably cooler than the remainder of the package, the consumer is able to grasp the flaps without experiencing discomfort.

Another object is to provide a package of the foregoing character that can be fabricated with only a slight change in manufacturing and with no or a very minor increase in production costs, yet the benefits are greatly increased in that the chance of burning one's fingers is for all intents and purposes completely obviated when removing the heated package from a microwave oven and during the subsequent handling and opening thereof.

Yet another object of the invention is to provide a package, especially one suited for popping corn, that can be shipped in a flat or collapsed condition with other such packages to the location where the packages are filled with the product to be heated, thereby avoiding any increase in shipping costs over what it would cost to ship conventional unfilled packages. Also, the invention permits the packages after filling to be compactly shipped in that the present invention does not add to the space that is needed.

Still another object is to provide a package involving a flexible bag that will not only prevent the consumer from burning his or her fingers but in which no sacrifice in heating efficiency is experienced. Stated somewhat differently, the package constituting a flexible bag functions in its normal manner as far as its heating effectiveness is concerned, yet the consumer can safely handle the package after the package and its contents have been heated to the required temperature.

A further feature of the present invention resides in providing a package with flaps, which remain unheated, that makes it obvious to the user that the flaps should be grasped when handling the bag, thereby avoiding the need for special instructions which the user might very well neglect to read before placing the package in a microwave oven.

Surprisingly, the above objectives can be satisfied by providing a package in the form of a flexible bag utilizing a susceptor pad therein for converting a percentage of the microwave energy to thermal energy so that the contents of the package will be effectively heated. Basically, the bag is of conventional construction, but the fabrication thereof is modified so that readily grasped flaps are available when handling the bag. In this way, the consumer can avoid touching any surface portion of the bag that is of an elevated temperature when removing the bag from the microwave oven after the bag and its contents have been sufficiently heated, the removal being easily achieved without danger of the consumer burning his or her fingers.

The present invention will become clearer in light of the following detailed description of an illustrative embodiment of this invention described in connection with the drawings.

BRIEF DESCRIPTION OF THE DRAWINGS

The illustrative embodiment may best be described by reference to the accompanying drawings where.

Figure 1:
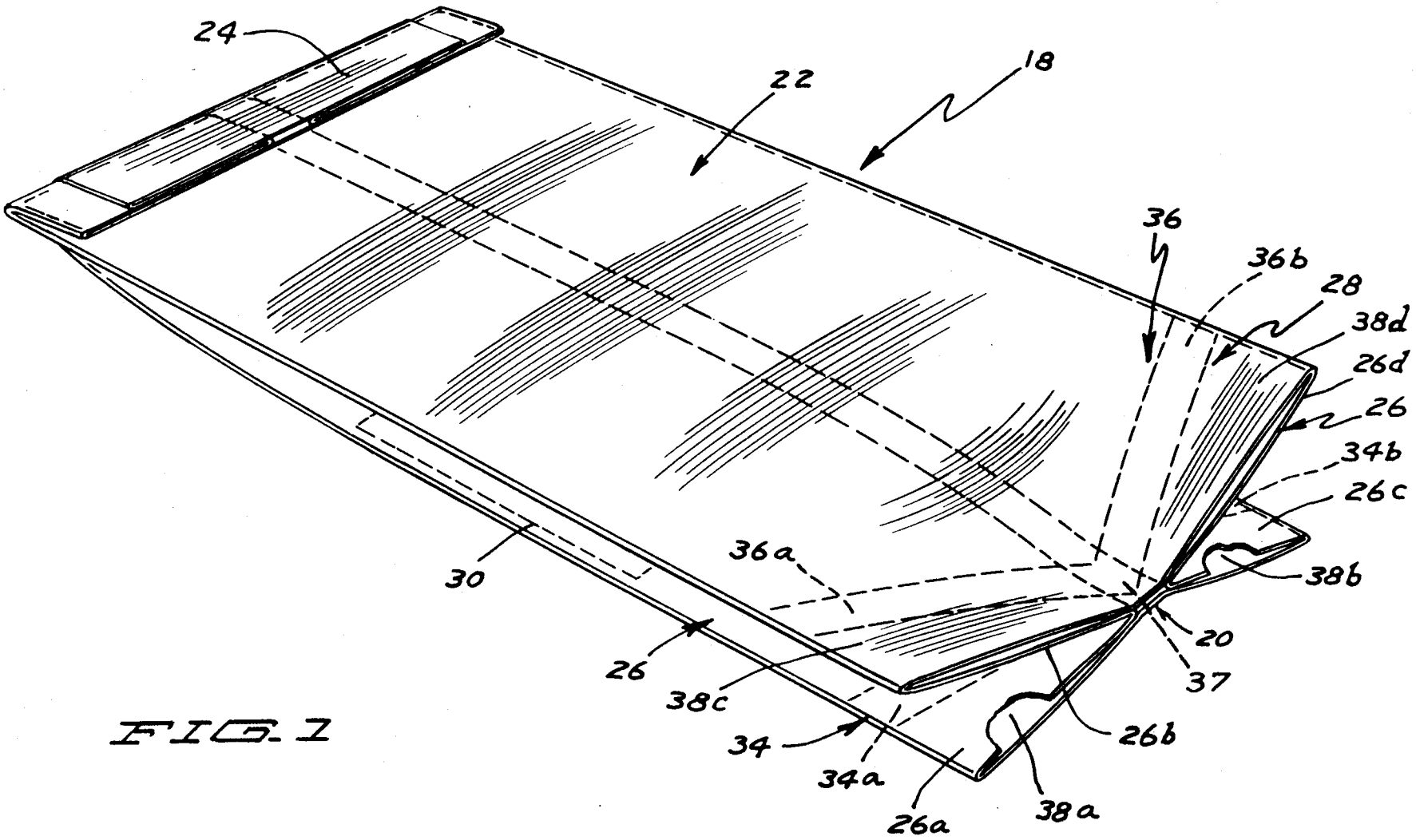
FIG. 1 shows a perspective view of a package fabricated in accordance with the preferred teachings of the present invention in generally its collapsed, storage condition, but illustrated slightly expanded to show constructional details.
Figure 2:
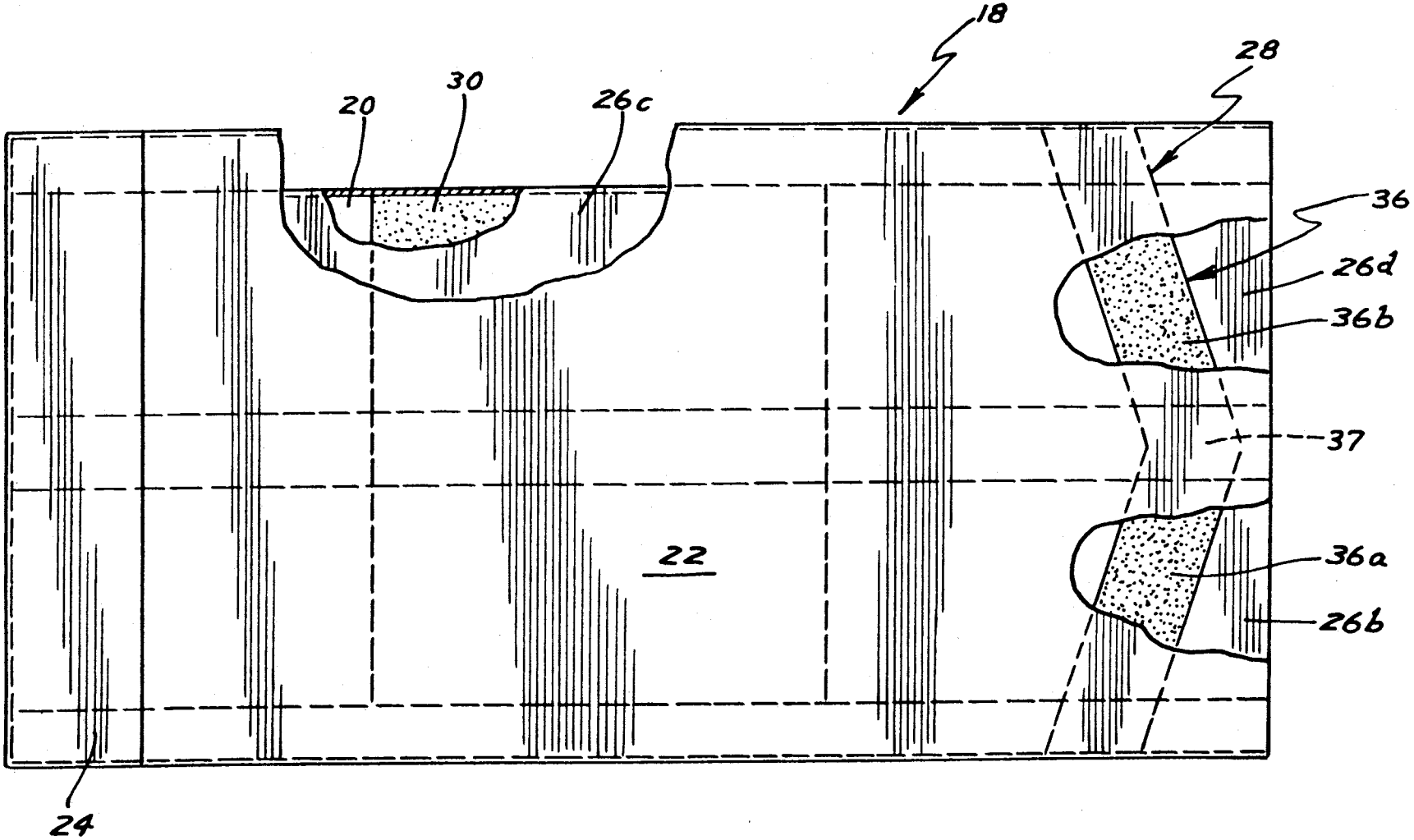
FIG. 2 shows a top plan view of the package of FIG. 1, with portions broken away to show constructional details.
Figure 3:
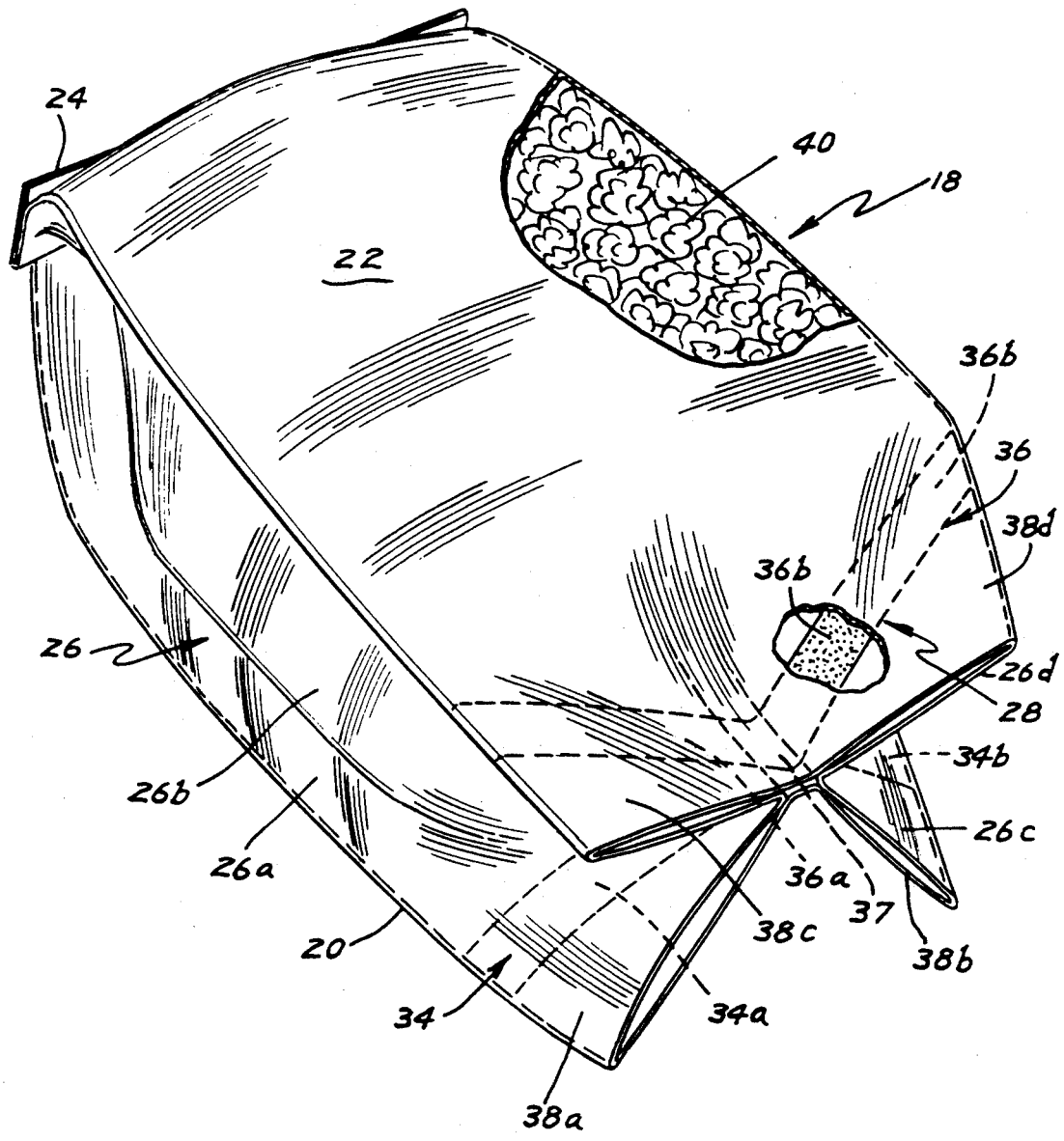
FIG. 3 shows a perspective view of the package of FIG. 1 in its expanded condition.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "side", "end", and similar terms are used herein, it should be understood that these terms have reference only to the structure shown in the drawings as it would appear to a person viewing the drawings and are utilized only to facilitate describing the invention.

DESCRIPTION OF THE PREFERRED EMBODIMENT

A package for use in microwave ovens according to the preferred teachings of the present invention is shown as a flexible bag in the drawings and generally designated 18. It will facilitate the ensuing description to consider bag 18 in the horizontal position when placed in the microwave oven as opposed to a vertical or upright position when the contents of bag 18 are being consumed by the consumer. Therefore, bag 18 includes a bottom wall 20, a top wall 22, an end wall 24, side walls 26 and a closed end 28. In the preferred form, the width of bottom wall 20 is less than the width of top wall 22, although the widths of walls 20 and 22 could be equal.

End wall 24 provides a non-opening permanent seal to the first end of bag 18. Particularly, the cross sectional makeup of end wall 24 includes a number of folds that are not important to an understanding of the present invention so will not be specifically described, although end wall 24 should be constructed so as to seal adequately the vapor created within bag 18 during the heating thereof in the microwave oven. In the preferred form of the present invention, end wall 24 is shown as being of the type shown in U.S. Pat. No. 4,973,810 and is formed by folding the first ends of bottom, top, and side walls 20, 22, and 26 over top wall 22. Alternatively, end wall 24 can have a flat rectangular or square configuration, with such bags being commonly referred to as square bottom bags in the trade. Further, bag 18 can optionally include the non-heated flap of the type shown and described in U.S. Pat. No. 4,864,090. However, it should be appreciated that end wall 24 can be a variety of types and configurations such as but not limited to the types shown in U.S. Pat. Nos. 3,973,045; 4,450,180; 4,691,374; and 5,044,777.

Side walls 26 include gussets or pleats **26*a*, 26*b*, 26*c* and 26*d* that enable side walls 26 to expand during a heating cycle. Particularly, in the preferred form, pleats 26*a* and 26*b* are connected together and have opposite edges connected to bottom wall 20 and top wall 22. Likewise, pleats 26*c* and 26*d* are connected together and have opposite edges connected to bottom wall 20 and top wall 22. In the preferred form, in its collapsed condition, pleats 26*a* and 26*c* have the same width and overlie bottom wall 20, and pleats 26*b* and 26*d* have the same width which is greater than the width of pleats 26*a* and 26*c* and overlie pleats 26*a* and 26*c*, with top wall 22 overlying pleats 26*b* and 26*d*. In the preferred form, bottom and top walls 20 and 22 have a width extending beyond the interconnections of pleats 26*a* and 26*b* and of pleats 26*c* and 26*d* when bag 18 is in its collapsed condition. The second, free ends of pleats 26*a*, 26*b*, 26*c* and 26*d* forming side walls 26, of bottom wall 20, and of top wall 22 are co-planar, and have the same extent from end wall 24**.

The present invention then relates to the manner of forming end 28 adjacent the second, free ends of bottom, top and side walls 20, 22, and 26 and which provides a peelable seal which fails during microwave cooking. This peelable seal failure allows trapped steam to vent from the package, as well as allowing the consumer to open bag 18 after microwave cooking and prior to eating. Particularly, end 28 is formed by first and second V-shaped adhesive strips 34 and 36. Strip 34 is located on bottom wall 20 having first and second, straight legs **34*a* and 34*b* interconnected by their first ends at an angle in the order of 140° and having their second ends extending to the interconnection of pleats 26*a* and 26*c* to bottom wall 20, respectively. Strip 36 overlies strip 34 and is located on top wall 22 having first and second, straight legs 36*a* and 36*b* interconnected by their first ends at an angle in the order of 140° and having their second ends extending to the interconnection of pleats 26*b* and 26*d* to top wall 22, respectively. The distance or spacing of the second ends of legs 34*a*, 34*b*, 36*a*, and 36*b* from the second, free ends of walls 20, 22, and 26 is greater than the distance or spacing of the first ends and intersections of legs 34*a*, 34*b*, 36*a*, and 36*b* from the second, free ends of walls 20, 22, and 26. It can then be appreciated that leg 34*a* adheres and seals pleat 26*a* to bottom wall 20, leg 34*b* adheres and seals pleat 26*c* to bottom wall 20, leg 36*a* adheres and seals pleat 26*b* to top wall 22, and leg 36*b* adheres and seals pleat 26*d* to top wall 22. Further, strips 34 and 36 adhere and seal bottom wall 20 to top wall 22 at their central portions 37 intermediate the interconnections of pleats 26*a* and 26*b* and of pleats 26*c* and 26*d***.

Areas **38*a*, 38*b*, 38*c* and 38*d* are formed and defined by the material between the free ends of walls 20, 22, and 26 and strips 34 and 36 and located on the opposite side of strips 34 and 36 forming the peelable seal than end 24, with areas 38*a*, 38*b*, 38*c*, and 38*d* being free of adhesive and unsealed in the preferred form. Due to the angular orientation of legs 34*a*, 34*b*, 36*a*, and 36*b*, areas 38*a*, 38*b*, 38*c*, and 38*d* are of a triangular configuration. Further, since the first ends of legs 34*a*, 34*b*, 36*a*, and 36*b* are located in the central portions 37 of bottom and top walls 20 and 22 having widths extending beyond pleats 26*a*, 26*b*, 26*c*, and 26*d* and since legs 34*a*, 34*b*, 36*a* and 36*b* extend therefrom in a linear manner at an obtuse angle to the opposite edges of pleats 26*a*, 26*b*, 26*c*, and 26*d*, areas 38*a*, 38*b*, 38*c*, and 38*d*** are of a large size for grasping by the consumer and specifically are considerably larger than flaps formed by adhesive extending at small angles relative to each other and only through the pleats such as when a box-like shape is desired as disclosed in U.S. Pat. No. 5,044,777.

Attention is now directed to a susceptor pad 30 that overlays a portion of bottom wall 20 spaced from end wall 24 and end 28. The material forming bag 18 is not important to an understanding of the present invention, so will not be specifically described. It might be explained, though, that bag 18 is fabricated from tubular bag stock composed of suitable flexible material such as paper including provisions for preventing wicking of the oil present in bag 18 during storage and for preventing leaking of the oil from bag 18 when the popcorn is being popped. Most bags currently utilized are typically laminated and composed of kraft paper lined with glassene paper or the equivalent thereof. The laminated construction of the walls constituting bag 18 is not shown. Actually, the layer of glassene paper could extend over the upper surface of susceptor pad 30.

It can then be appreciated that bag 18 can be manufactured as current bags are manufactured for example of the type shown and described in U.S. Pat. Nos. 4,450,180; 4,735,513; 4,878,765; or 4,691,374. In this regard, bag 18 can be formed by cutting a web of material to length, folding that length of material to form the tubular bag stock including bottom, top, and side walls 20, 22, and 26, and then forming end wall 26 by folding and adhering bottom, top and side walls 20, 22, and 26. It should be noted that the overlapping edges of the web of material forming the tubular bag stock has been omitted in the Figures for ease of illustration. It should also be noted that the free, second ends of bottom, top, and side walls 20, 22, and 26 are all of the same length and specifically do not require any special cuts and/or do not require extra components to form tabs or flaps.

It can further be appreciated that bag 18 can be filled with the desired food product as current bags are filled for example of the type shown and described in U.S. Pat. No. 4,450,180. After filling, strips 34 and 36 can be adhered to walls 20, 22, and 26 utilizing standard equipment presently utilized to form the peelable seal of current bags. Particularly, in the preferred form, rather than apply adhesive adjacent and parallel to the free ends of bottom and top walls 20 and 22 as in current bags, adhesive strips 34 and 36 are applied spaced from the second, free ends of the bottom and top walls 20 and 22 and in the most preferred form are applied at an angular relation thereto. It can then be appreciated that bag 18 of the present invention can be fabricated with only a slight change in manufacturing (i.e., the manner which strips 34 and 36 are applied) and with no or very minor increase in production costs.

It of course should be appreciated that the particular manner of manufacture and filling of bag 18 can be done in a variety of ways and manners such as but not limited to the example set forth above.

For the sake of completeness, it will be assumed that the contents of bag 18 are popcorn kernels and the popped kernels have been generally indicated by the reference numeral 40, having been popped when in the microwave oven. Particularly, as with current bags, bag 18 in a collapsed condition is placed in a microwave oven with bottom wall 20 resting upon the bottom surface of the oven cavity. When subjected to microwave energy, susceptor pad 30 converts microwave energy into heat, with the heat and remaining microwave energy causing the popping of the kernels and the creation of water vapor. The water vapor and heated air cause side walls 26 to expand, expanding bag 18 and increasing the volume inside of bag 18 for popped kernels 40. It can then be appreciated that due to its flexible nature, bag 18 will expand to a football like shape, including separating pleats 26*a* and 26*b* and pleats 26*c* and 26*d* adjacent to the second ends of bottom, top and side walls 20, 22, and 26.

Consequently, with the foregoing description in mind, it should now be apparent that areas 38*a*, 38*b*, 38*c* and 38*d* function as flaps, each of which presents a considerable surface area separated from the interior of bag 18 by strips 34 and 36, and at the same time spaced from susceptor pad 30. Particularly, strips 34 and 36 prevent the expansion forces generated by the creation of water vapor and the popping of the kernels from expanding the volume between top and bottom walls 20 and 22 and pleats 26*a*, 26*b*, 26*c*, and 26*d* in areas 38*a*, 38*b*, 38*c*, and 38*d* between the second free ends of walls 20, 22, and 26 and strips 34 and 36. It can then be appreciated that areas 38*a*, 38*b*, 38*c*, and 38*d* form flaps which the consumer has a natural tendency to grip between the thumb and one or more fingers whereas the remaining portions of bag 18 would have to be gripped using two hands due to the ball-like shape of the remaining portions of bag 18. Also, strips 34 and 36 tend to insulate heat transfer from the interior of bag 18 to areas 38*a*, 38*b*, 38*c*, and 38*d* between walls 20, 22, and 26 adjacent the second, free ends thereof. Further, the unsealed nature of areas 38*a*, 38*b*, 38*c*, and 38*d* allows air to flow and be trapped between the layers of paper forming walls 20, 22, and 26 outside of strips 34 and 36 and which maintains a cooler surface temperature. Hence, it is difficult for any heat generated within the confines of bag 18 to reach areas 38*a*, 38*b*, 38*c*, and 38*d*. Thus, areas 38*a*, 38*b*, 38*c*, and 38*d*, which once again constitute free flaps, remain unheated and can be readily grasped by the consumer, even though the remainder of bag 18 is at an appreciably elevated temperature, a temperature entirely too hot for a person to touch without being burned.

It should further be appreciated that the triangular shape of areas 38*a*, 38*b*, 38*c*, and 38*d* and the angular orientation of strips 34 and 36 is advantageous. Particularly, in current bags, the adhesion of walls 20, 22 and 26 in a face to face arrangement generally prevents the expansion forces generated by the creation of water vapor and the popping of the kernels from expanding current bags such that the walls adjacent end 28 extend in a contiguous manner and take a ball-like shape, but rather the walls adjacent end 28 in current bags will extend at an angular relation especially adjacent the interconnections of walls 20 and 22 to pleats 26*a*, 26*b*, 26*c*, and 26*d*. Thus, the increased volume by the expansion of bag 18 at the second, free ends of walls 20, 22, and 26 is minor in comparison to the expansion created by expanding pleats 26*a*, 26*b*, 26*c*, and 26*d* in the middle of bag 18. The angular orientation of strips 34 and 36 moves the interconnection of walls 20 and 22 to pleats 26*a*, 26*b*, 26*c* and 26*d* inwardly especially adjacent the interconnections of walls 20 and 22 to pleats 26*a*, 26*b*, 26*c*, and 26*d*, with the expansion forces tending to cause the walls to extend in a contiguous manner and take a ball-like shape. Thus, the creation of areas 38*a*, 38*b*, 38*c*, and 38*d* in the material beyond strips 34 and 36 does not dramatically decrease the potential volume inside of bag 18 for popped kernels 40 and/or water vapor. Thus, the extent of walls 20, 22, and 26 does not have to be increased according to the preferred teachings of the present invention and without detrimental effect on the use and function of bag 18, and particularly, the present invention eliminates the need for increased material for forming areas 38*a*, 38*b*, 38*c*, and 38*d* in the manufacture of bag 18.

Closed end 28 is readily opened by grasping two of areas 38*a*, 38*b*, 38*c*, and 38*d* while bag 18 is in the upright position to peal the seal created by strips 34 and 36. It should also be noted that again areas 38*a*, 38*b*, 38*c*, and 38*d* can be readily grasped by the consumer due to the cooler surface temperature thereof compared to the elevated temperature of the remainder of bag 18.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Package for use in a microwave oven comprising, in combination: a flexible bag including a bottom wall, a top wall, and at least a first side wall extending between the top and bottom walls, with the top, bottom and side walls including first and second ends, with the first side wall including at least first and second pleats with the pleats being connected together and having opposite edges connected to the bottom wall and the top wall, with the bag further including an end wall at the first ends of the top, bottom and side walls; susceptor means for converting microwave energy into heat overlying a portion of the bottom wall spaced from the first and second ends of the bottom wall; and a peelable seal between the first pleat and the bottom wall and between the second pleat and the top wall adjacent the second ends of the top, bottom, and side walls which fails during microwave cooking allowing trapped steam to vent from the package and allowing the consumer to open the package after microwave cooking, with the peelable seal being spaced from the second ends of the top, bottom and side walls to define at least first and second unsealed areas located on the side of the peelable seal opposite the end wall and allowing air to flow between the side, top and bottom walls from the second ends of the side, top and bottom walls to the peelable seal to maintain the unsealed areas at a cooler surface temperature than the remainder of the package for grasping by the consumer.

2. The package of claim 1 wherein the unsealed areas are of a triangular configuration.

3. The package of claim 2 wherein the top and bottom walls have a width extending beyond the first and second pleats, with the unsealed areas extending to the width of the top and bottom walls beyond the first and second pleats and on the side of the peelable seal opposite the end wall for grasping by the consumer.

4. The package of claim 3 wherein the bag includes a second side wall extending between the top and bottom walls opposite to the first side wall, with the second side wall including at least third and fourth pleats, with the third and fourth pleats being connected together and having opposite edges connected to the bottom wall and the top wall, with the peelable seal located between the third pleat and the bottom wall and between the fourth pleat and the top wall.

5. The package of claim 4 wherein the second side wall has first and second ends, and wherein the peelable seal is spaced from the second ends of the second side wall and the top and bottom walls to define third and fourth unsealed areas located on the side of the peelable seal opposite the end wall for grasping by the consumer.

6. The package of claim 5 wherein the peelable seal is formed by first and second V-shaped adhesive strips with each of the adhesive strips formed from first and second, straight legs intersecting at an obtuse angle.

7. The package of claim 6 wherein the second ends of the top, bottom and side walls are coplanar and have the same extent from the end wall.

8. The package of claim 7 wherein the width of the bottom wall is less than the width of the top wall, with the width of the first and third pleats being equal and the width of the second and fourth pleats being equal and greater than the width of the first and third pleats.

9. The package of claim 8 wherein the end wall is formed by folding the first ends of the top, bottom, and side walls over the top wall.

10. The package of claim 5 wherein the second ends of the top, bottom and side walls are coplanar and have the same extent from the end wall.

11. The package of claim 1 wherein the second ends of the top, bottom and side walls are coplanar and have the same extent from the end wall.

12. The package of claim 10 wherein the unsealed areas are of a triangular configuration.

13. The package of claim 1 wherein the bag includes a second side wall extending between the top and bottom walls opposite to the first side wall, with the second side wall including at least third and fourth pleats, with the third and fourth pleats being connected together and having opposite edges connected to the bottom wall and the top wall, with the peelable seal located between the third pleat and the bottom wall and between the fourth pleat and the top wall.

14. The package of claim 12 wherein the second side wall has first and second ends, and wherein the peelable seal is spaced from the second ends of the second side wall and the top and bottom walls to define third and fourth unsealed areas located, on the side of the peelable seal opposite the end wall for grasping by the consumer.

15. The package of claim 13 wherein the peelable seal is formed by first and second V-shaped adhesive strips, with each of the adhesive strips formed from first and second, straight legs intersecting at an obtuse angle.

16. The package of claim 13 wherein the unsealed areas are of a triangular configuration.

17. Package for use in a microwave oven comprising, in combination: a flexible bag including a bottom wall, a top wall, and first and second side walls extending between the top and bottom walls, with the top, bottom and side walls including first and second ends, with each of the first and second side walls including at least first and second pleats with the pleats being connected together and having opposite edges connected to the bottom wall and the top wall, with the first pleats overlying the bottom and the top overlying the second pleats, with the top and bottom walls having widths extending beyond the first and second pleats, with the bag further including an end wall at the first ends of the top, bottom and side walls; susceptor means for converting microwave energy into heat overlying a portion of the bottom wall spaced from the first and second ends of the bottom wall; a first straight peelable seal between the first pleat of the first side wall and the bottom wall and between the top and bottom walls adjacent the second ends of the top and bottom walls and the first pleat of the first side wall; a second straight peelable seal between the second pleat of the first side wall and the top wall and between the top and bottom walls adjacent the second ends of the top and bottom walls and the second pleat of the first side wall; a third straight peelable seal between the first pleat of the second side wall and the bottom wall and between the top and bottom walls adjacent the second ends of the top and bottom walls and the first pleat of the second side wall; and a fourth straight peelable seal between the second pleat of the second side wall and the top wall and between the top and bottom walls adjacent the second ends of the top and bottom walls and the second pleat of the second side wall, with the second straight peelable seal overlying the first straight peelable seal and the fourth straight peelable seal overlying the third straight peelable seal, with the first and third peelable seals intersecting at an obtuse angle on the bottom wall and the second and fourth peelable seals intersecting at an obtuse angle on the top wall, with the distance of the peelable seals from the second ends of the bottom, top, and side walls being greater at the edges of the pleats opposite at the intersections of the peelable seals, with the peelable seals failing during microwave cooking allowing trapped steam to vent from the package and allowing the consumer to open the package after microwave cooking, with the peelable seals being spaced from the second ends of the top, bottom and side walls to define first, second, third, and fourth areas located on the opposite side of the peelable seal than the end wall for grasping by the consumer.

18. The package of claim 17 wherein the second ends of the top, bottom and side walls are coplanar and have the same extent from the end wall.

19. The package of claim 18 wherein the intersections of the peelable seals are spaced from the second ends of the bottom, top, and side walls.

20. The package of claim 19 wherein the width of the bottom wall is less than the width of the top wall, with the width of the first and third pleats being equal and the width of the second and fourth pleats being equal and greater than the width of the first and third pleats.

* * * * *